US005357933A

United States Patent [19]

Kasahara et al.

[11] Patent Number: 5,357,933

[45] Date of Patent: Oct. 25, 1994

[54] FUEL INJECTION DEVICE

[75] Inventors: Toshiaki Kasahara; Hiroshi Ishiwata, both of Higashimatsuyama, Japan

[73] Assignee: Zexel Corporation, Tokyo, Japan

[21] Appl. No.: 94,900

[22] Filed: Jul. 22, 1993

[30] Foreign Application Priority Data

Jul. 23, 1992 [JP] Japan ..... 4-217314

[51] Int. Cl.[5] ..... F02D 1/00; F02D 5/00

[52] U.S. Cl. ..... 123/506; 123/458; 123/446

[58] Field of Search ..... 123/500, 501, 506, 467, 123/458, 446

[56] References Cited

U.S. PATENT DOCUMENTS 4,392,612 7/1983 Deckard et al. .
4,485,969 12/1984 Deckard et al. .
4,537,171 8/1985 Kuroyanagi et al. ..... 123/506
4,709,679 12/1987 Djordjevic et al. ..... 123/506
4,745,898 5/1988 Egler et al. ..... 123/506
4,805,580 2/1989 Buisson et al. ..... 123/467
4,969,600 11/1990 Nicol ..... 123/506
5,029,568 7/1991 Perr ..... 123/506

FOREIGN PATENT DOCUMENTS 2-81951 3/1990 Japan .

*Primary Examiner*—E. Rollins Cross
*Assistant Examiner*—Thomas N. Moulis
*Attorney, Agent, or Firm*—Wenderoth, Lind & Ponack

[57] ABSTRACT

ABSTRACT A solenoid valve is provided in a fuel injection pump fuel supply path. A communication path communicates with each other an armature chamber, which accommodates an armature, and a spill chamber, which accommodates a head of a valve body and is connected to a lower pressure side. When high pressure fuel is spilt to the low pressure side, an orifice in the communication path reduces a high frequency pressure wave propagated from the spill chamber to the armature chamber, thus reducing deformation or corrosion of the solenoid in over a long period of use.

6 Claims, 3 Drawing Sheets

FUEL INJECTION DEVICE

BACKGROUND OF THE INVENTION

1. Field of the Invention

This invention relates to the control of fuel injection from a fuel injection pump used for diesel engines or the like and, more particularly, to a system for controlling fuel injection with a solenoid valve provided on high and low pressure sides of the pump.

2. Related Art

In a well-known fuel injection device, a solenoid valve is provided in a fuel injection pump between the high pressure side thereof communicating with a compression chamber and the low pressure side leading to a fuel inlet. In the intake stroke, the high and low pressure sides are communicated to introduce fuel into the compression chamber from the low pressure side. In the compression stroke, the high and low pressure sides are blocked from each other for fuel injection. The end of the fuel injection is determined by adjusting the timing of causing the escape of high pressure fuel from the high pressure side to the low pressure side, i.e. the timing of the opening the solenoid valve.

In a fuel injection controller of this type, which was developed by the applicant, an armature is connected to a valve body of a solenoid valve, a spill chamber for causing the spill of high pressure fuel is formed around a head of the valve body, and an armature chamber accommodating the armature is formed around the armature. Further, a communication path communicating the spill and armature chambers is formed inside or around the valve body for pressure balance between the two chambers.

However, the fuel which is spilt from the high pressure side at the end of the fuel injection is under a very high pressure, typically 1,500 kg/cm$^2$ and it was found that with the momentary fuel spill to the low pressure side caused with the opening of the solenoid valve a spike-like high frequency pressure wave, as shown by solid line in FIG. 3, is propagated from the spill chamber through the communication path to the armature chamber. The high pressure wave is propagated around the armature to strike the solenoid stator or the like. This is liable to result in deformation and corrosion of the solenoid surface over a long period of use.

To reduce damage due to this high pressure wave, it is thought to mount a thin metal sheet on the stator surface facing the armature. Doing so, however, undesirably reduces the electromagnetic force.

Besides, as shown in the solid line in FIG. 3, the armature chamber pressure is very low preceding the high pressure wave; actually it is presumed to be negative. This very low pressure causes a delay in the operation of opening the solenoid valve and has adverse effects on the fuel injection cut required for the fuel injection pump, that is, the rapid spill performance thereof.

SUMMARY OF THE INVENTION

An object of the invention is to provide a fuel injection device, which, while securing a communication path between a spill chamber around a valve head and an armature chamber around an armature for taking pressure balance between the two chambers, can suppress high pressure wave propagation from the spill chamber to the armature chamber to reduce the possibilities of deformation and corrosion of the solenoid over long use and also preclude the low (or negative) pressure state of the armature chamber to permit a quicker opening operation of the solenoid valve.

To attain the above object of the invention, there is provided a fuel injection device which comprises a solenoid valve provided in a fuel injection pump between the high pressure side thereof communicating with a compression chamber and the low pressure side for controlling the state of communication between the high and low pressure sides, the solenoid valve comprising a valve body having a valve head accommodated in a spill chamber formed in an intermediate portion of the fuel supply path, an armature accommodated in an armature chamber and connected to the valve body, a solenoid for driving the armature to cause the valve head out of and into engagement with a valve seat so as to open and close the fuel supply path, a return spring biasing the valve body against the electromagnetic force provided by the solenoid, and a communication path communicating the spill chamber and the armature chamber and having a reduced sectional area orifice formed in an intermediate portion.

Thus, in the intake stroke of the fuel injection pump the valve body is opened by the return spring. Thus, fuel introduced from the fuel inlet is led from the low pressure side to the high pressure side, and low pressure fuel is led into the combustion chamber. In the compression stroke, the armature is attracted by the electromagnetic force of the solenoid. Thus, the valve is closed to check returning of high pressure side fuel to the low pressure side, and fuel compressed in the compression chamber is injected. In this process, the valve body is moved smoothly because a substantially equal pressure is set in the spill chamber and the armature chamber through the communication path.

In the latter stage of the compression stroke, the valve body is opened to reduce the pressure on the high pressure side to be lower than the fuel injection start pressure of the pump, whereupon the fuel injection is ended. At this time, the high pressure fuel on the high pressure side is momentarily returned to the low pressure side simultaneously with the separation of the valve head from the valve seat, and a quick pressure variation wave accompanied by a spike-like high frequency pressure wave tends to be propagated to various parts communicating with the spill chamber. However, the orifice formed in the communication path has the effect of reducing the propagation of the quick pressure variation wave accompanied by the high frequency pressure wave to the armature chamber. Thus, pressure impacts on the solenoid are alleviated, and at the same time the low pressure state of the armature chamber is precluded.

DETAILED DESCRIPTION OF THE PREFERRED EMBODIMENT

An, an embodiment of the invention will now be described with reference to the drawings.

Figure 1:
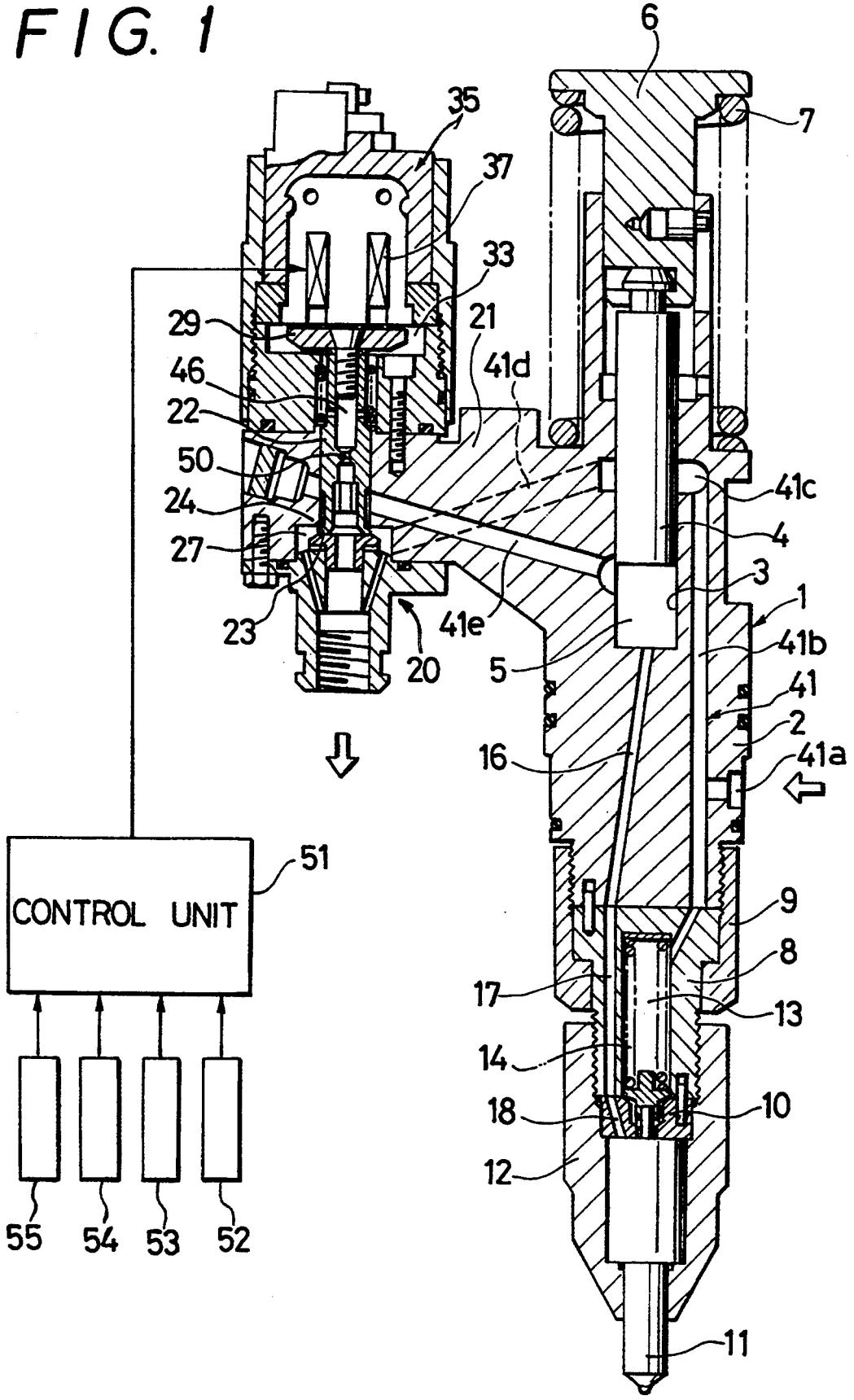
FIG. 1 is a schematic representation of an embodiment of a fuel injection device according to the invention.

FIG. 1 shows an embodiment of a fuel injection device. The device has a fuel injection pump 1 of a unit injector system for injecting fuel into each diesel engine cylinder, for instance. The fuel injection pump 1 has a plunger barrel 2 having a stem portion formed with a cylinder 3, in which a plunger 4 is slidably fitted. A compression chamber 5 is defined by the plunger barrel 2 and plunger 4. The plunger 4 is spring biased away from the plunger barrel 2 (i.e., upward in the Figure) by a spring 7 provided between a tappet 6 coupled to the spring and the plunger barrel 2. The tappet 6 is in contact with a cam (not shown) formed on an engine drive shaft, and with rotation of the drive shaft it causes reciprocations of the plunger 4 in cooperation with the spring 7.

A holder 8 is provided by a holder nut 9 on the tip of the plunger barrel 2. A nozzle 11 is coupled with a retaining nut 12 to the holder 8 via a spacer 10. The holder 8 has a spring accommodation chamber 13 accommodating a nozzle spring 14 biasing a needle valve (not shown) provided in the nozzle 11 downward in the Figure. The nozzle 11 has a well-known structure. When high pressure fuel under a pressure in excess of a predetermined pressure is supplied from the compression chamber 5 in the plunger tip through a discharge duct 16 and communication ducts 17 and 18 formed in the holder 8 and spacer 10 to the nozzle 11, the needle valve is opened to cause the injection of fuel from an injection port formed at the nozzle end.

Figure 2:
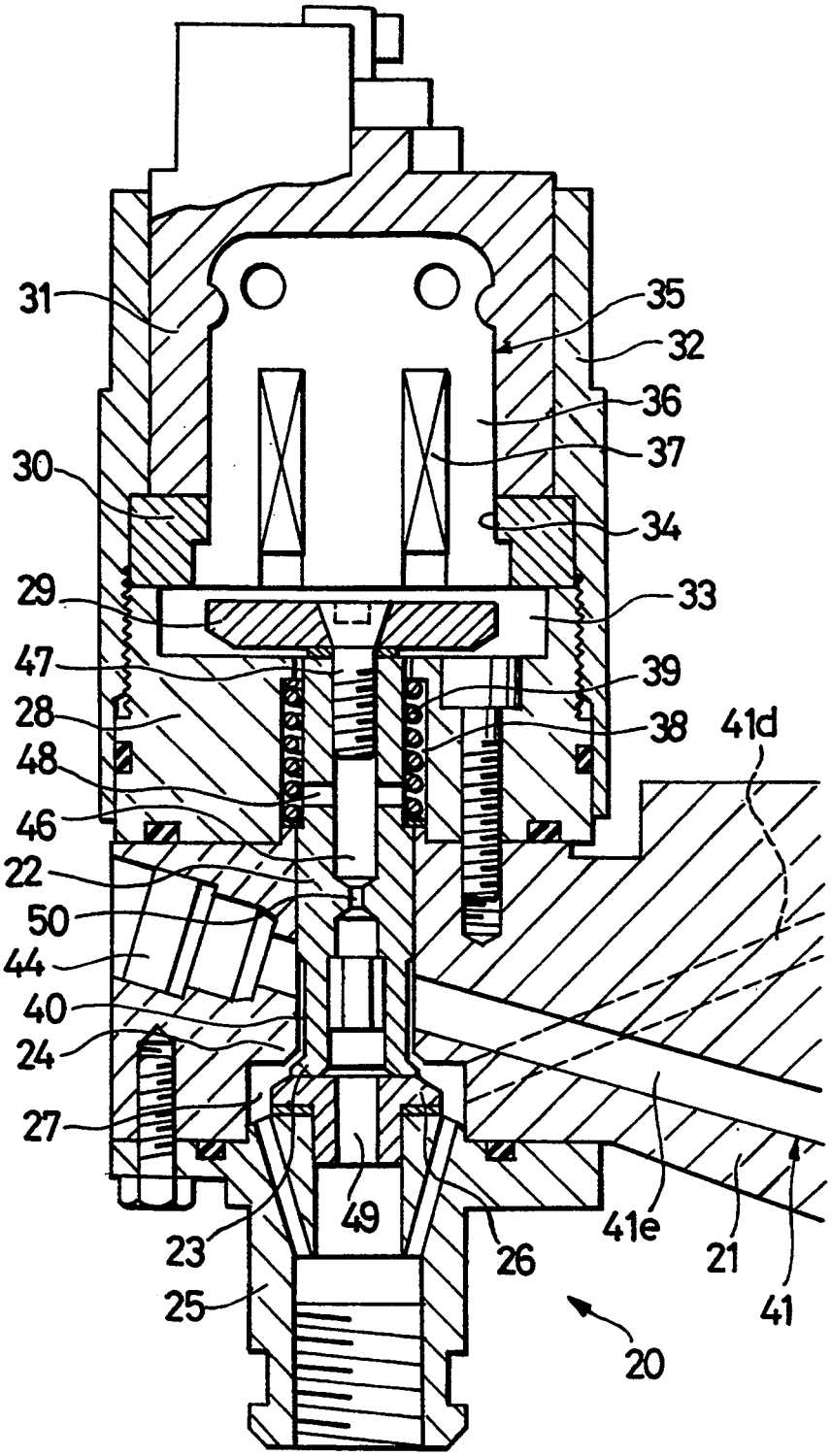
FIG. 2 is an enlarged sectional view showing a solenoid valve in the fuel injection device of in FIG. 1.

A solenoid valve 20, as shown in FIG. 2, comprises a valve housing 21 provided on the pump body and a valve body 22 slidably fitted in the valve housing 21. The valve housing 21 has a valve seat 24 for engagement with a valve head 23 at an end of the valve body 22. A header 25 is screwed to the valve housing 21 to cover the valve head 23. The header 25 is provided with a stopper 26 for the valve body 22. A spill chamber 27, which accommodates the valve head 23, is defined by the valve housing 21 and the header 25.

The valve body 22 is inserted in a holder 28, which is screwed to the valve housing 21 on the side thereof opposite the header 25, and is connected to an armature 29. A solenoid accommodation barrel 31 is assembled by a holder nut 32 to the holder 28 via a spacer 30. The armature 29 is accommodated in an armature chamber 33, which is defined by the holder 28 and spacer 30, and faces a solenoid 35 accommodated in the solenoid accommodation barrel 31 via a mounting hole 34 in the spacer 30.

The solenoid 35 has a stator 36 accommodating a coil 37. The end face of the stator 36 is aligned with the end face of the spacer 30. A spring accommodation chamber 38 is defined by the holder 28 and a spring receptacle provided on the periphery of the valve body 22. A return spring 39 is accommodated and held in the spring accommodation chamber 38, and it biases the valve head 23 away from the valve seat 24. Thus, when and only when the solenoid is energized, the armature 29 is attracted to the stator 36 against the spring force of the return spring 39, and the valve head 23 is seated in the valve seat 24. The valve body 22 has a reduced outer diameter portion or an annular recess 46 extending from the back of the valve head 23 toward the return spring. The annular recess 40 serves as a communication groove for leading fuel from the high pressure side to the low pressure side, or vice versa, when the valve head 23 is separated from the valve seat 24. The plunger barrel 2 has a fuel supply duct 41 formed in it. The fuel supply duct 41 includes a fuel inlet port 41*a*, a duct 41*b* having one end open to an annular groove 41*c* formed in the wall surface of the cylinder 3 normally facing the plunger periphery, a duct 41*d* having one end open to the annular groove 41*c* and the other end in communication with the spill chamber 27, and a duct 41*e* having one end connected to the annular recess 40 noted above and the other end open to the compression chamber 5. The solenoid valve 20 makes the ducts 41*a* to 41*d* the low pressure side and the duct 41*e* the high pressure side.

Designated at 44 is a blind plug closing the duct 41*e*.

During the intake stroke of the plunger 4 going upward, fuel introduced into the duct 41*b* from the fuel inlet 41*a* is supplied from the low pressure side to the high pressure side to be led into the compression chamber 5. During the compression stroke, in which the plunger 4 goes downward, the valve head 23 is seated in the valve seat 24, whereby the fuel in the compression chamber is compressed to be injected from the nozzle 11. When the valve head 23 is separated from the valve seat 24 during the compression stroke, the high pressure side fuel leaks to the low pressure side through the annular recess 40.

The valve body 22 of the solenoid valve 20 has an axial bore 46 extending from its end having the valve head 23 to its other end connected to the armature 29. The bore 46 has an armature side threaded portion for mounting the armature 29 on the valve body 22. A screw 47 inserted through a central hole of the armature 29 is screwed in and closes the threaded bore portion. Ahead of the screw 47, the axial bore 46 communicates with a radial bore 48 that is open to the spring accommodation chamber 38. The axial and radial bores 46 and 48, spring accommodation chamber 38 and the clearance between holder 28 and valve body 22 form a communication path 49 communicating the spill and armature chambers 27 and 33 with each other.

Ahead of the radial bore 48, the axial bore 46 forming the communication path 49 has an orifice portion 50 having a reduced sectional area.

The energization of the solenoid 35 is controlled by a control unit 51. The control unit 51 comprises an A/D converter, a multiplexer, a microcomputer, a memory, a drive circuit, etc., and it receives signals from an engine rotation sensor 52 for detecting the engine rotation, an accelerator opening sensor 53 for sensing the extent of depression of accelerator pedal (i.e., accelerator opening), a reference pulse generator 54 mounted on the drive shaft for generating a pulse whenever a reference angle position is reached by the drive shaft and a needle valve lift sensor 55 for detecting the needle valve lift timing. According to these signals, the control unit 51 calculates energization start and end timings, etc., to energize the solenoid for the required time interval and thus control the "on" period of the solenoid valve during the compression stroke.

Figure 3:
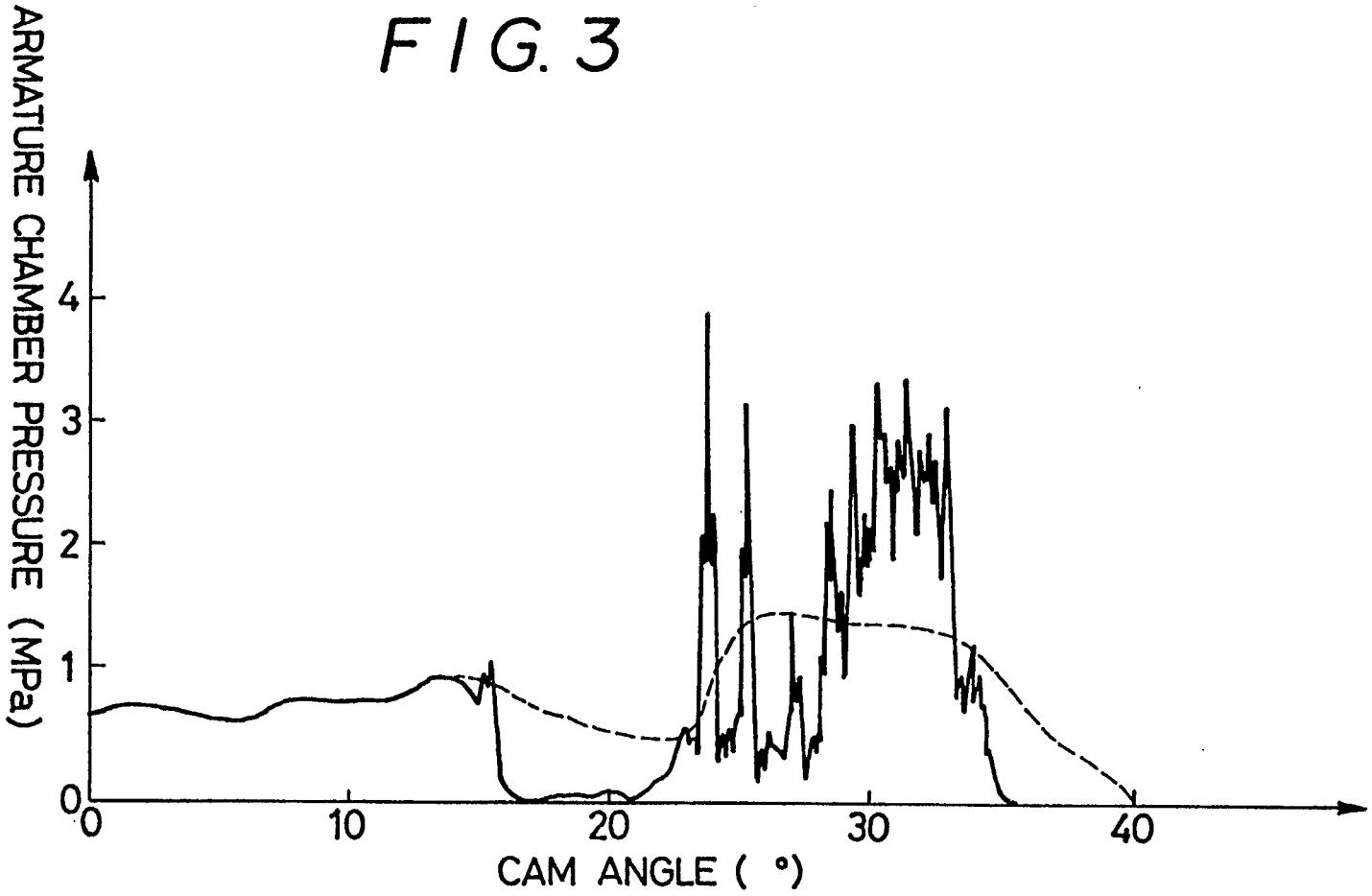
FIG. 3 is a graph showing experimental data of armature chamber pressure variations in the solenoid valve.

With the above construction, in the intake stroke of the fuel injection pump the solenoid 35 is not energized. Thus, the armature 29 integral with the valve body 22 is separated from the stator 36 by the return spring 39, and also the valve head 23 is separated from the valve seat 24. In this situation, low pressure fuel introduced to the low pressure side from the fuel inlet 41*a* is led through the annular recess 40 to the high pressure side to be supplied to the compression chamber 5. In the compression stroke, the energization of the solenoid is started. Thus, the armature 29 is attracted to the stator 36, and the valve head 23 is seated in the valve seat 24. As a result, the communication between the low and high pressure sides is blocked, and compressed fuel is injected from the nozzle 11. In the latter stage of the compression stroke, the solenoid is de-energized, causing the valve head 23 to be separated from the valve seat 24 again to cause high pressure fuel on the high pressure side to be returned through the annular recess 40 to the low pressure side. The pressure on the high pressure side thus is quickly reduced to end the fuel injection. When the high pressure fuel is returned to the low pressure side, a quick pressure variation wave accompanying the high frequency pressure wave noted before tends to be propagated to various parts communicated with the spill chamber 27 through the communication path 49. However, the orifice 50, provided as part of the axial bore 46 and constituting part of the communication path 49, serves to reduce the propagation of the quick pressure variation wave accompanying the high frequency pressure to the armature chamber 33 communicating with the spill chamber 27, as shown by a dashed line in FIG. 3. Thus, the high frequency pressure wave propagated around the armature 29 to the surfaces of the solenoid 35 is suppressed. Thus impacts on coil coating resin and the like are alleviated. It is thus possible to eliminate or alleviate deformation or corrosion of the solenoid and the like over a long period of use. Further, the low pressure state of the armature chamber is precluded, and a quick opening operation the solenoid valve is ensured.

In the above embodiment a unit injector is used as the fuel injection pump 1, but the control according to the invention may be utilized for any type of fuel injection pump, such as a distribution type or a row type.

As has been described in the foregoing, according to the invention an orifice is provided on a communication path communicating a spill and an armature chamber of a solenoid valve such that it can alleviate the propagation of a quick pressure variation wave accompanying a high frequency pressure wave to the armature chamber when fuel leaks from the high pressure side to the low pressure side of the fuel injection pump. It is thus possible to avoid strong impacts on the surfaces of the solenoid to suppress deformation or corrosion of the stator surfaces or coil coating resin in long use. Thus, there is no need of providing a thin iron sheet on the stator surfaces to alleviate the high frequency pressure impacts. Also, there is no increase in the number of components. Further, the electromagnetic force is not reduced. Furthermore, a quicker opening operation of the solenoid valve can be obtained to improve the rapid spill property.

What is claimed is:

1. An apparatus, comprising:

a plunger barrel having a cylinder therein;

a plunger in said cylinder, said plunger defining a compression chamber in said cylinder;

an injection nozzle communicating with said compression chamber;

a fuel supply path communicating with said compression chamber; and a solenoid valve in said fuel supply path, said solenoid valve comprising a spill chamber, said spill chamber defining a portion of said fuel supply path, a valve body having a valve head accommodated in said spill chamber, an armature chamber having an armature therein, said armature being connected to said valve body, a solenoid adjacent to said armature, a return spring biasing said valve body in one direction and a communication path communicating said spill chamber and said armature chamber, wherein said communication path comprises an intermediate portion having an orifice of a sectional area smaller than other portions of said communication path;

wherein a spring accommodation chamber accommodates said return spring, a space on the outer periphery of said valve body communicates said spring accommodation chamber and said armature chamber, and said communication path is defined by an axial bore in said valve body communicating with said spill chamber, a radial bore in said valve body communicating said spring accommodation chamber with said axial bore, said spring accommodation space and said space on the outer periphery of said valve body.

2. The apparatus of claim 1, wherein said intermediate portion of said communication path, having said orifice, is defined by said axial bore.

3. The apparatus of claim 1, wherein said valve head of said valve body is in a position closing said fuel supply path when said solenoid is energized, said valve body having been moved against the force of said spring, and wherein said fuel supply path is open when said solenoid is de-energized, said valve body having been moved by said spring.

4. The apparatus of claim 1, wherein said solenoid valve includes a valve housing on one side of said plunger barrel, said valve body being slidably mounted in said valve housing and said valve housing defining a valve seat, and a header mounted on said valve housing so as to cover said valve head, and wherein said spill chamber is defined by said valve housing and said valve header, said solenoid is provided in said valve housing on a side of said valve housing opposite of said header and facing said armature, said spring biases said valve head of said valve body away from said valve seat, and said fuel supply path has one portion communicating with said spill chamber and another portion communicating with the outer periphery of said valve body.

5. An apparatus, comprising:

a plunger barrel having a cylinder therein;

a plunger in said cylinder, said plunger defining a compression chamber in said cylinder;

an injection nozzle communicating with said compression chamber;

a fuel supply path communicating with said compression chamber; and a solenoid valve in said fuel supply path, said solenoid valve comprising a spill chamber, said spill chamber defining a portion of said fuel supply path, a valve body having a valve head accommodated in said spill chamber, an armature chamber having an armature therein, said armature being connected to said valve body, a solenoid adjacent to said armature, a return spring biasing said valve body in one direction and a communication path communicating said spill chamber and said armature chamber, wherein said communication path comprises an intermediate portion having an orifice of a sectional area smaller than other portions of said communication path;

wherein said valve head of said valve body is in a position closing said fuel supply when said solenoid is energized, said valve body having been moved against the force of said spring, and wherein said fuel supply path is open when said solenoid is de-energized, said valve body having been moved by said spring.

6. An apparatus, comprising:

a plunger barrel having a cylinder therein;

a plunger in said cylinder, said plunger defining a compression chamber in said cylinder;

an injection nozzle communicating with said compression chamber;

a fuel supply path communicating with said compression chamber; and a solenoid valve in said fuel supply path, said solenoid valve comprising a spill chamber, said spill chamber defining a portion of said fuel supply path, a valve body having a valve head accommodated in said spill chamber, an armature chamber having an armature therein, said armature being connected to said valve body, a solenoid adjacent to said armature, a return spring biasing said valve body in one direction and a communication path communicating said spill chamber and said armature chamber, wherein said communication path comprises ann intermediate portion having an orifice of a sectional area smaller than other portions of said communication path;

wherein said solenoid valve includes a valve housing on one side of said plunger barrel, said valve body being slidably mounted in said valve housing and said valve housing defining a valve seat, and a header mounted on said valve housing so as to cover said valve head, and wherein said spill chamber is defined by said valve housing and said valve header, said solenoid is provided in said valve housing on a side of said valve housing opposite of said header and facing said armature, said spring biases said valve head of said valve body away from said valve seat, and said fuel supply path has one portion communicating with said spill chamber and another portion communicating with the outer periphery of said valve body.

* * * * *